US009947269B2

(12) United States Patent
Jung et al.

(10) Patent No.: US 9,947,269 B2
(45) Date of Patent: Apr. 17, 2018

(54) ORGANIC LIGHT EMITTING DISPLAY AND CIRCUIT THEREOF

(71) Applicant: LG Display Co., Ltd., Seoul (KR)

(72) Inventors: Sanghoon Jung, Goyang-si (KR); Jungchul Kim, Paju-si (KR); Junyoung Kwon, Busan (KR); Jungyoup Suk, Paju-si (KR); Kiyoung Sung, Seoul (KR)

(73) Assignee: LG Display Co., Ltd., Seoul (KR)

( * ) Notice: Subject to any disclaimer, the term of this patent is extended or adjusted under 35 U.S.C. 154(b) by 7 days.

(21) Appl. No.: 15/164,554

(22) Filed: May 25, 2016

(65) Prior Publication Data

US 2016/0351122 A1 Dec. 1, 2016

(30) Foreign Application Priority Data

May 28, 2015 (KR) ..... 10-2015-0075330
Oct. 30, 2015 (KR) ..... 10-2015-0152672
Apr. 30, 2016 (KR) ..... 10-2016-0053638

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/2085* (2013.01); *G09G 3/3266* (2013.01);
(Continued)

(58) Field of Classification Search
CPC .. G09G 3/3241; G09G 3/3233; G09G 3/3266; G09G 3/3291; G09G 2300/0426;
(Continued)

(56) References Cited

U.S. PATENT DOCUMENTS 6,859,193 B1 * 2/2005 Yumoto ..... G09G 3/3216 315/169.3
2003/0132931 A1 7/2003 Kimura et al.
(Continued)

FOREIGN PATENT DOCUMENTS

CN 104123910 A 10/2014
JP 4498669 B2 7/2003
(Continued)

OTHER PUBLICATIONS

Korean Office Action, Korean Application No. 10-2016-0053638, dated Feb. 28, 2017, pages (with concise explanation of relevance).
European Extended Search Report, European Application No. 16171308.6, dated Sep. 27, 2016, 9 pages.
Korean Office Action, Korean Application No. 10-2016-0117573, dated Jul. 31, 2017, 6 pages (with concise explanation of relevance).

*Primary Examiner* — Stephen G Sherman
(74) *Attorney, Agent, or Firm* — Fenwick & West LLP

(57) ABSTRACT

An organic light emitting display comprises a display panel having a plurality of pixels, a gate drive circuit that drives scan lines and emission lines on the display panel, and a data drive circuit that drives data lines on the display panel. Each of the pixels is arranged in an nth row. A single frame for the organic light emitting display comprises an initial period in which the gate voltage of a driving transistor is initialized, a sampling period for compensating the threshold voltage of the driving transistor, and a light emission period in which an organic light emitting diode emits light. A value corresponding to an image signal to be displayed by the organic light emitting diode is applied to a data line during the sampling period, and an initial voltage is applied to one electrode of a capacitor during the initial period.

20 Claims, 19 Drawing Sheets

(51) Int. Cl.
*G09G 3/20* (2006.01)
*G09G 3/3266* (2016.01)

(52) U.S. Cl.
CPC ..... *G09G 2300/0819* (2013.01); *G09G 2300/0842* (2013.01); *G09G 2300/0861* (2013.01); *G09G 2310/0216* (2013.01); *G09G 2310/0264* (2013.01); *G09G 2320/045* (2013.01); *G09G 2330/021* (2013.01); *G09G 2330/028* (2013.01)

(58) Field of Classification Search
CPC ..... G09G 2300/043; G09G 2300/0814; G09G 2300/0819; G09G 2300/0861; G09G 2310/0251; G09G 2310/0262; G09G 2310/0278; G09G 2320/043
USPC ..... 345/76–83, 691; 315/169.3
See application file for complete search history.

(56) References Cited

U.S. PATENT DOCUMENTS

2010/0045586 A1* 2/2010 Kim ..... G02F 1/136213 345/98
2012/0287025 A1 11/2012 Inoue et al.
2015/0325705 A1* 11/2015 Choi ..... G02F 1/134363 257/72

FOREIGN PATENT DOCUMENTS

KR 10-2007-0027265 A 3/2007
KR 10-2011-0092820 A 8/2011
KR 10-2011-0121889 A 11/2011
KR 10-1404951 B1 5/2012
KR 10-2012-0070773 A 7/2012
KR 10-2015-0072213 A 6/2015

* cited by examiner

ORGANIC LIGHT EMITTING DISPLAY AND CIRCUIT THEREOF

CROSS-REFERENCE TO RELATED APPLICATIONS

This application claims the priority benefit of Korean Patent Application No. 10-2015-0075330 filed on May 28, 2015, Korean Patent Application No. 10-2015-0152672 filed on Oct. 30, 2015, and Korean Patent Application No. 10-2016-0053638 filed on Apr. 30, 2016, which are each hereby incorporated by reference in its entirety.

BACKGROUND

Field

The present disclosure relates to an active-matrix organic light emitting display and a circuit thereof.

Discussion of the Related Art

An active-matrix organic light emitting display comprises self-luminous organic light emitting diodes OLED, and has the advantages of fast response time, high luminous efficiency, high luminance, and wide viewing angle. An organic light emitting diode, which is a self-luminous device, has the structure shown in FIG. 1. The organic light emitting diode comprises an anode and a cathode, and organic compound layers formed between the anode and the cathode. The organic compound layers comprise a hole transport layer HTL, an emission layer EML, and an electron transport layer ETL. When an operating voltage is applied to the anode and the cathode, a hole (indicated by "+" in FIG. 1) passing through the hole transport layer HTL and an electron (indicated by "−" in FIG. 1) passing through the electron transport layer ETL move to the emission layer EML, and form an exciton. As a result, the emission layer EML generates visible light.

In an organic light emitting display, pixels each comprising an organic light emitting diode are arranged in a matrix, and the luminance of the pixels is adjusted based on the grayscale of video data. Each individual pixel comprises a driving transistor that controls the driving current flowing through the organic light emitting diode based on a gate-source voltage, a capacitor that keeps the gate-source voltage of the driving transistor constant for one frame, and at least one switching transistor that programs the gate-source voltage of the driving transistor in response to a gate signal. A driving current is determined by the driving transistor's gate-source voltage corresponding to a data voltage, and the luminance of the pixel is proportional to the amount of driving current flowing through the organic light emitting diode.

Such an organic light emitting display has variations in driving current even with the same data voltage because the threshold voltage of the driving transistor varies between the pixels due to process deviation, variation of gate-bias stress with time, etc.

SUMMARY

In an exemplary embodiment of this disclosure, an organic light emitting display comprises a display panel having a plurality of pixels, a gate drive circuit that drives scan lines and emission lines on the display panel, and a data drive circuit that drives data lines on the display panel. Each of the pixels is arranged in an nth row (n is a natural number) includes a driving transistor having a gate electrode connected to a node A, a source electrode connected to a node B, and a drain electrode connected to a node C, and the driving transistor controlling a driving current applied to an organic light emitting diode, a first transistor that is connected between the data lines and the node B, a second transistor that is connected between the node A and a high-level driving voltage input terminal, a third transistor that is connected to the node B and the organic light emitting diode, a fourth transistor that is connected to the node C and the high-level driving voltage input terminal, a fifth transistor that is connected to the node A and the node C, a sixth transistor that is connected between a node D and an initial voltage input terminal, the node D located between the third transistor and the organic light emitting diode, and a capacitor that is connected to the node A and the node D.

In another exemplary embodiment of this disclosure, a circuit of an organic light emitting display comprises a transistor array having at least one transistor, and a capacitor that is connected between an initial voltage input terminal and the at least one transistor, the capacitor having a first electrode and a second electrode. The area of the first electrode that receives an initial voltage is larger than the area of the second electrode.

In another exemplary embodiment of this disclosure, an organic light emitting display comprises a display panel having a plurality of pixels, each of the pixels including a driving transistor, and organic light emitting diode, and a capacitor electrically connected to each other. A single frame includes an initial period in which a gate voltage of the driving transistor is initialized, a sampling period for compensating a threshold voltage of the driving transistor, and a light emission period in which the organic light emitting diode emits light. A value corresponding to an image signal to be displayed by the organic light emitting diode is applied to the data line during the sampling period, and an initial voltage is applied to at least one electrode of the capacitor during the initial period.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
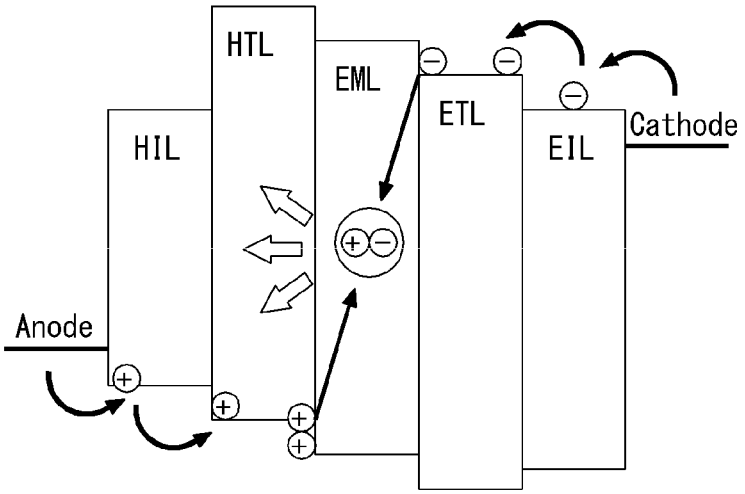
FIG. 1 is a view showing an organic light emitting diode and the principle of light emission by the organic light emitting diode.

The various aspects and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the exemplary embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure. When the terms 'comprise', 'have', 'include' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

When the temporal relationship between two events is described using the terms 'after', 'following', 'next', 'before' and the like, the two events may not occur in succession as long as the term 'immediately' or 'directly' is not used.

It will be understood that, although the terms first, second, etc., may be used to describe various elements, these elements should not be limited by these terms. These terms are only used to distinguish one element from another element. Thus, a first element discussed below could be termed a second element without departing from the technical spirit of the present disclosure.

The features of various exemplary embodiments of the present disclosure may be combined with one another either partly or wholly, and may technically interact or work together in various ways. The exemplary embodiments may be carried out independently or in combination with one another.

An organic light emitting display for threshold voltage compensation requires a sampling period for sampling the threshold voltage of a driving transistor before pixels are charged with a data voltage. As display panels have higher resolution, the length of 1 horizontal period (H) is shortened and thus the sampling period is also shortened. The shortened sampling period leads to lower threshold voltage compensating capability, thus resulting in an adverse effect on the display quality of the display panels.

Moreover, if an organic light emitting display uses a reference voltage to sample the threshold voltage of a driving transistor, a data driver needs to swing between the reference voltage and the data voltage. Here, the data voltage is a data value for an image to be displayed. Accordingly, the data driver's output voltage undergoes many transitions because the data driver outputs the reference voltage and the data voltage alternately, resulting in higher power consumption.

In addition, if a substrate where transistors are disposed is formed of a polyimide material, mobile charges can be easily trapped. The trapped mobile charges may affect a semiconductor layer of the transistors and reduce driving current, thus deteriorating the performance of the transistors.

One aspect of this disclosure is to provide an organic light emitting display that can reduce power consumption by allowing for efficient compensation of the threshold voltage of a driving transistor.

Another aspect of this disclosure is to provide a compensation circuit for minimizing the effect of a mobile charge trapped in a substrate on a semiconductor layer of transistor.

The aspects of the present disclosure are not limited to the above-mentioned aspects, and other aspects will be clearly apparent to those skilled in the art from the following description.

Hereinafter, exemplary embodiments of the present disclosure will be described in detail with reference to the accompanying drawings.

Figure 2:
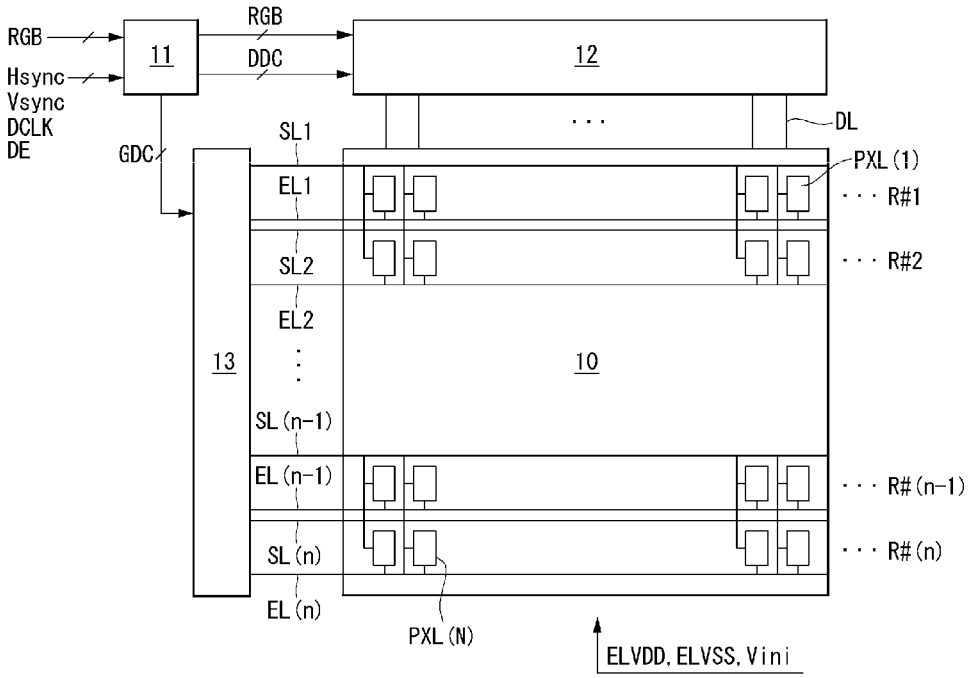
FIG. 2 is a view showing an organic light emitting display according to an exemplary embodiment of the present disclosure.

FIG. 2 is a view showing an organic light emitting display according to an exemplary embodiment of the present disclosure.

Referring to FIG. 2, an organic light emitting display according to an exemplary embodiment of the present disclosure comprises a display panel 10 with pixels PXL arranged in a matrix, a data driver 12 for driving data lines DL, a gate driver 13 for driving scan lines SL and emission lines EL, and a timing controller 11 for controlling the operation timings of the data driver 12 and gate driver 13.

A plurality of pixels PXL are disposed on the display panel 10, and the pixels PXL are connected to the data lines DL, scan lines SL, and emission lines EL. The data lines DL are arranged in a column direction, and transmit a data voltage Vdata received from the data driver 12 to the pixels PXL. The first to nth scan lines SL are arranged in pixel rows R#1 to R#(n) (n is a natural number) in a row direction, respectively, and transmit a scan voltage received from the gate driver 13 to the pixels PXL. The first to nth emission lines EL are arranged in the pixel rows R#1 to R#(n) in the row direction, respectively, and transmit an emission voltage received from the gate driver 13 to the pixels PXL.

The pixels PXL may commonly receive a high-level driving voltage ELVDD, low-level driving voltage ELVSS, and an initial voltage Vini from a power generator. The initial voltage Vini may be chosen from a range of voltages well lower than the low-level driving voltage ELVSS to prevent unnecessary light emission by the organic light emitting diodes OLED.

The transistors comprising each pixel PXL may be implemented as oxide transistors having an oxide semiconductor layer. The oxide transistors are advantageous for the display panel 10 to have a large area, when electron mobility, process deviation, etc. are all taken into consideration. The oxide semiconductor layer may be formed of, but is not limited to, ITO (indium tin oxide), IZO (indium zinc oxide), IGZO (indium gallium zinc oxide), or ITZO (indium tin zinc oxide). The present disclosure is not limited to the oxide transistors, but the semiconductor layer of the transistors may be formed of amorphous silicon (a-Si), polycrystalline silicon (poly-Si), organic semiconductor, etc.

Each individual pixel PXL comprises a plurality of transistors and capacitors to compensate for changes in the threshold voltage of the driving transistor. A pixel structure according to the exemplary embodiment of the present disclosure will be described later.

The timing controller 11 re-aligns digital video data RGB input from an external source to match the resolution of the display panel 10 and supplies it to the data driver 12. Also, the timing controller 11 generates a data control signal DDC for controlling the operation timing of the data driver 12 and a gate control signal GDC for controlling the operation timing of the gate driver 13, based on timing signals such as a vertical synchronization signal Vsync, a horizontal synchronization signal Hsync, a dot clock signal DCLK, and a data enable signal DE.

The data driver 12 converts the digital video data RGB input from the timing controller 11 to an analog data voltage based on the data control signal DDC. The data driver 12 supplies the data voltage to the data lines DL. The data voltage may have a value corresponding to an image signal to be displayed by an organic light emitting diode OLED.

The gate driver 13 generates a scan signal and an emission signal based on the gate control signal GDC. The gate driver 13 sequentially provides a scan signal SCAN to the scan lines SL and sequentially provides an emission signal EM(j) to the emission lines EL. That is, the gate driver 13 sequentially provides the scan signal SCAN to the first to nth scan lines SL and the emission signal EM(j) to the first to nth emission lines EL. The gate driver 13 may be formed directly in a non-display area of the display panel 10 according to the GIP (gate-driver-in-panel) technology.

Figure 3:
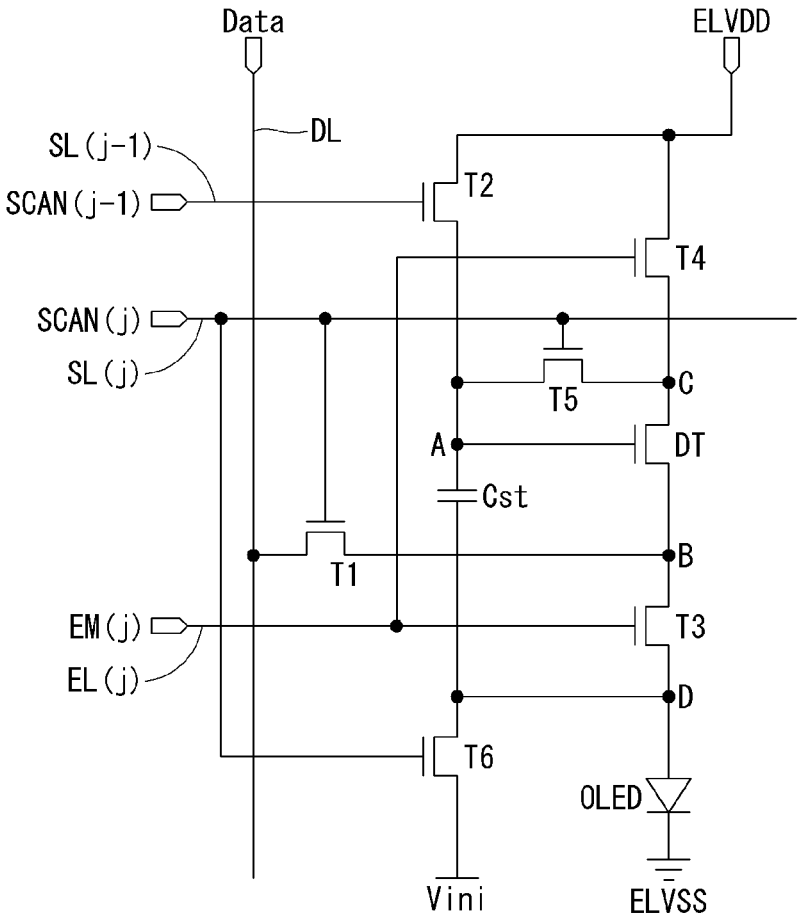
FIG. 3 is a view showing a pixel structure according to a first exemplary embodiment.
Figure 4:
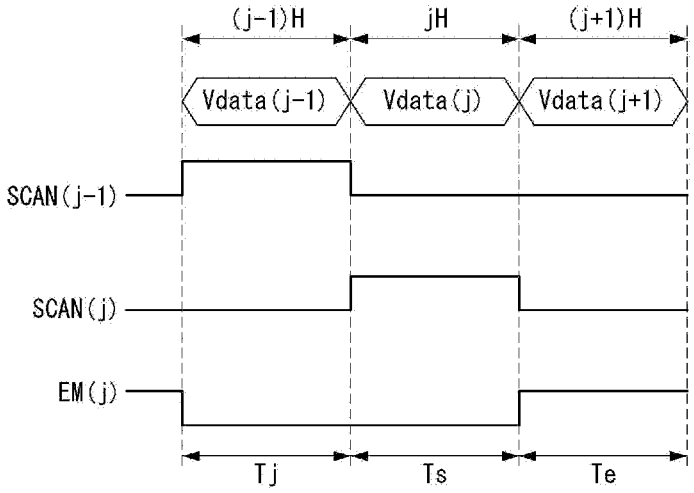
FIG. 4 is a timing diagram showing gate signals according to the first exemplary embodiment.

FIG. 3 is a view showing a pixel structure according to a first exemplary embodiment. FIG. 4 is a view showing gate signals provided to the pixel shown in FIG. 3.

Referring to FIG. 3, pixels PXL(j) arranged in a jth row will be described below.

The pixels PXL(j) arranged in the jth row R#j (j is a natural number less than n) are connected to a (j−1)th scan line SL(j−1), a jth scan line SL(j), and a jth emission line EL(j).

Each of the pixels PXL(j) comprises an organic light emitting diode OLED, a driving transistor DT, first transistor to sixth transistor T1 to T6, and a capacitor Cst. The exemplary embodiment discloses N-type transistors, the semiconductor type of the transistors is not limited thereto. If the first transistor to the sixth transistor T1 to T6 are implemented as P-type, the gate signals SCAN(j), SCAN (j−1), and EM(j) shown in FIG. 4 should be inverted. Compared to P-type transistors, N-type transistors allow for faster current flow, thus offering a higher switching speed. Also, the first transistor to the sixth transistors T1 to T6 may be PMOS transistors, CMOS transistors, etc.

The organic light emitting diode OLED emits light by a driving current supplied from the driving transistor DT. The organic light emitting diode OLED comprises multiple layers of organic layers between an anode and a cathode. The organic layers may comprise at least one among a hole transfer layer, an electron transfer layer, and an emission layer EML. The hole transfer layer includes a layer that injects or transfers holes into the emission layer, for example, it may be a hole injection layer HIL, a hole transport layer HTL, an electron blocking layer EBL, etc. The electron transfer layer includes a layer that injects or transfers electrons into the emission layer, for example, it may be an electron transport layer ETL, an electron injection layer EIL, a hole blocking layer HBL, etc.

The anode of the organic light emitting diode OLED is connected to a node D, and the cathode of the organic light emitting diode OLED is connected to an input terminal of the low-level driving voltage ELVSS.

The driving transistor DT controls the driving current applied to the organic light emitting diode OLED based on its gate-source voltage Vgs. A gate electrode of the driving transistor DT is connected to a node A, its source electrode is connected to a node B, and its drain electrode is connected to a node C.

First and second electrodes of the first transistor T1 are connected to the node B and a data line DL, respectively, and its gate electrode is connected to the jth scan line SL(j). That is, the first transistor T1 is switched on in response to the jth scan signal SCAN(j) and transmits a data voltage from the data line DL to the node B.

First and second electrodes of the second transistor T2 are connected to the node A and an input terminal of the high-level driving voltage ELVDD, respectively, and its gate electrode is connected to the (j−1)th scan line SL(j−1). That is, the second transistor T2 transmits the high-level driving voltage ELVDD to the node A in response to the (j−1)th scan signal SCAN(j−1).

First and second electrodes of the third transistor T3 are connected to the node B and the organic light emitting diode OLED, respectively, and its gate electrode is connected to the jth emission line EL(j). That is, the third transistor T3 switches the current path between the driving transistor DT and the organic light emitting diode OLED, in response to the jth emission signal EM(j).

First and second electrodes of the fourth transistor T4 are connected to the node C and the input terminal of the high-level driving voltage ELVDD, respectively, and its gate electrode is connected to the jth emission line EL(j). That is, the fourth transistor T4 transmits the high-level driving voltage ELVDD to the node C in response to the jth emission signal EM(j).

First and second electrodes of the fifth transistor T5 are connected to the node A and the node C, respectively, and its gate electrode is connected to the jth scan line SL(j).

First and second electrodes of the sixth transistor T6 are connected to the node D and the initial voltage Vini, respectively, and its gate electrode is connected to the jth scan line SL(j).

The capacitor Cst is connected between the node A and the node D. The capacitor Cst may be used to sample the threshold voltage of the driving transistor according to the source follower configuration.

Figure 5A:
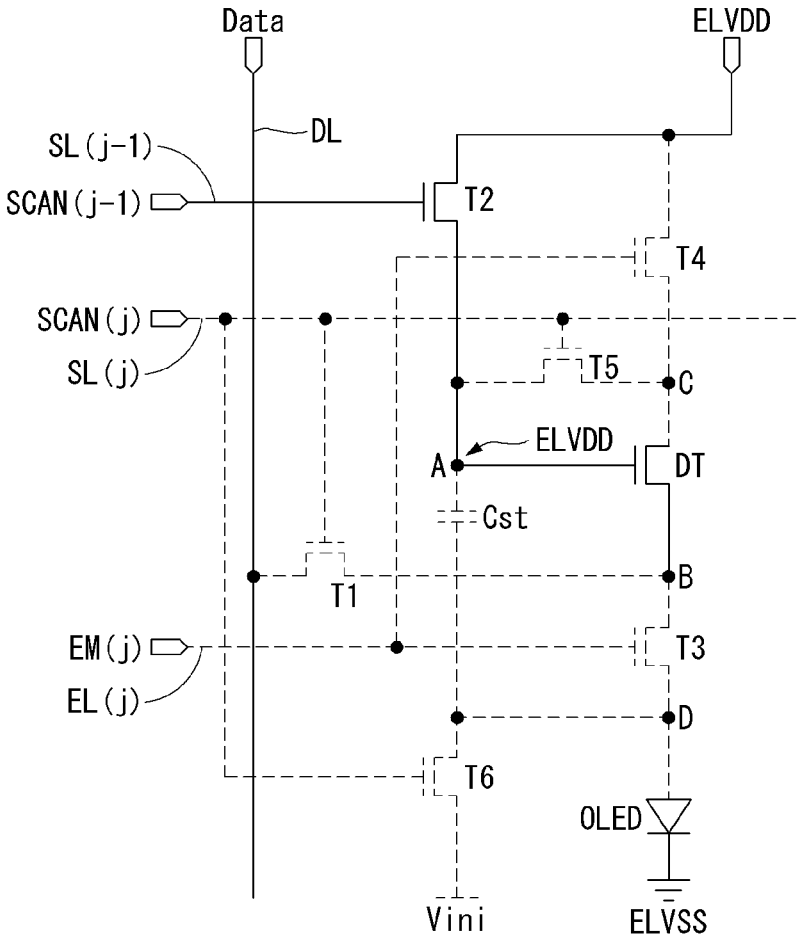
FIG. 5A is an equivalent circuit diagram for explaining operation of pixels during an initial period according to the first exemplary embodiment.
Figure 5B:
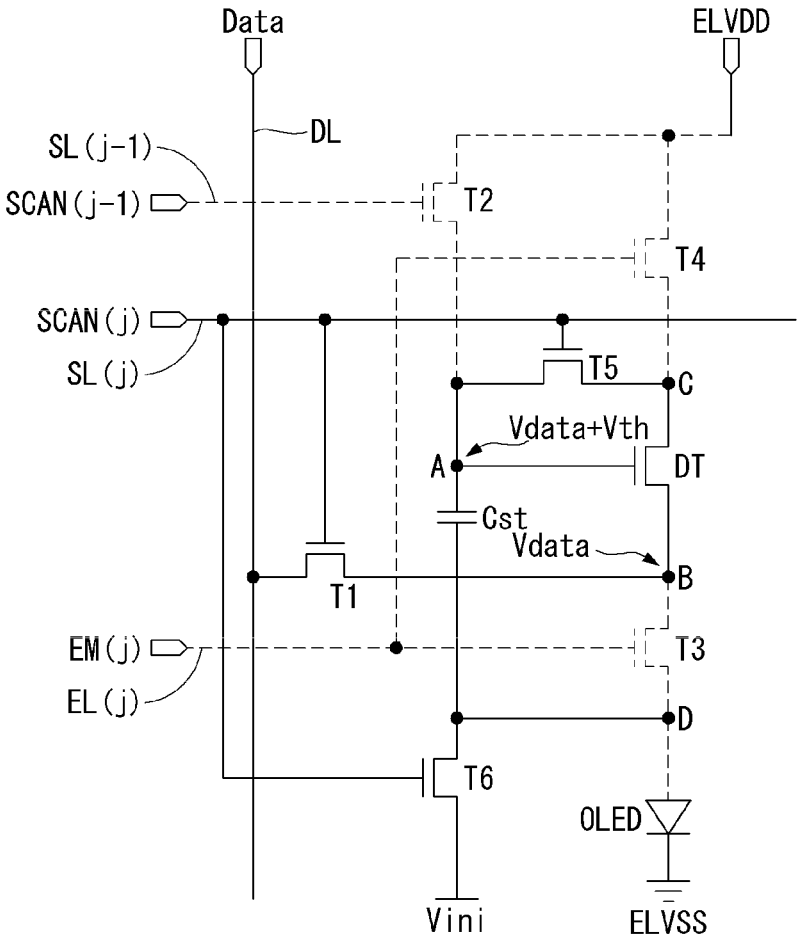
FIG. 5B is an equivalent circuit diagram for explaining operation of pixels during a sampling period according to the first exemplary embodiment.
Figure 5C:
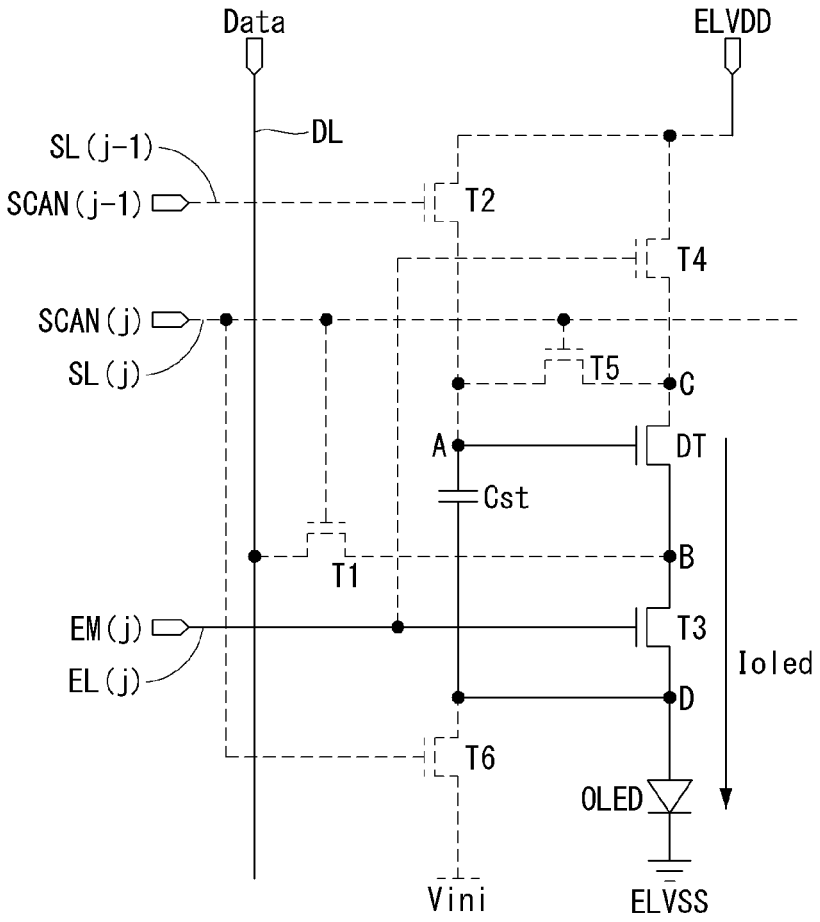
FIG. 5C is an equivalent circuit diagram for explaining operation of pixels during a light emission period according to the first exemplary embodiment.

In the first exemplary embodiment, the operation of the pixels arranged in the jth row R#j will be described below with reference to FIG. 4 and FIGS. 5A through 5C and [Table 1]. FIGS. 5A to 5C are equivalent circuit diagrams for explaining operation of the pixels in response to driving signals. [Table 1] is a table showing the voltages for each node corresponding to t operation periods of the pixels.

The first to sixth transistors T1 to T6 according to the first exemplary embodiment are implemented as N-type transistors. Thus, the high-level driving voltage of each driving signal represents a turn-on voltage for the transistors, and the low-level driving voltage of each driving signal represents a turn-off voltage for the transistors.

The operation of each pixel comprises an initial period Tj, a sampling period Ts, and a light emission period Te shown in FIG. 4. The initial period Tj, sampling period Ts, and light emission period Te each process for 1 horizontal period 1H. A jth horizontal period jH may be defined as a period in which the jth scan signal SCAN(j) is provided to the pixel of the jth row R#j.

For each pixel, a single frame may comprise an initial period Tj in which the gate voltage of the driving transistor is initialized, a sampling period Ts for compensating the threshold voltage of the driving transistor, and a light emission period Te in which the organic light emitting diode OLED emits light. During the sampling period Ts, a value corresponding to an image signal to be displayed by the organic light emitting diode OLED may be applied to the data line DL. Also, an initial voltage may be applied to at least one electrode of the capacitor during the initial period Tj. The sampling period Ts may comprise a period in which the initial period Tj is held.

TABLE 1

| | Initial period | Sampling period | Light emission period |
|---|---|---|---|
| Node A | ELVDD | Vdata + Vth | Vdata + Vth + (Voled − Vini) |
| Node B | Voled | Vdata | Voled |
| Node D | Voled | Vini | Voled |

In FIG. 5A, the transistors that operate during the initial period Tj are indicated by the solid lines, and the transistors that do not operate during this period are indicated by the dotted lines. Referring to FIGS. 4 and 5A, the initial period Tj processes for a (j−1)th horizontal period (j−1)H allocated to drive a (j−1)th pixel row.

During the initial period Tj, the (j−1)th scan signal SCAN(j−1) is input at the high-voltage level, and the jth scan signal SCAN(j) and the emission signal EM(j) are input at the low-voltage level. The second transistor T2 turns on in response to the (j−1)th scan signal SCAN(j−1), and provides the high-level driving voltage ELVDD to the node A. That is, the node A is reset to the high-level driving voltage ELVDD during the initial period Tj. The jth emission signal EM(j) is inverted to a turn-off voltage level, and the third transistor T3 turns off. As a result, the current path between the driving transistor DT and the organic light emitting diode OLED is interrupted during the initial period Tj. In this case, the node B and the node D may have the driving voltage Voled of the organic light emitting diode OLED that was applied to it during the light emission period of the previous frame, but the organic light emitting diode OLED does not emit light since the operating voltage Voled of the organic light emitting diode is not actually held. Thus, the voltages of the node B and node D will be denoted by "Voled" in [Table 1], for convenience.

In FIG. 5B, the transistors that operate during the sampling period Ts are indicated by the solid lines, and the transistors that do not operate during this period are indicated by the dotted lines. Referring to FIGS. 4 and 5B, the sampling period Ts processes for the jth horizontal period jH in which a data voltage is applied to the pixels arranged in the jth pixel row.

During the sampling period Ts, the (j−1)th scan signal SCAN(j−1) is inverted to the low-voltage level, and the jth scan signal SCAN(j) is inverted to the high-voltage level. The emission signal EM(j) is held at the low-voltage level. As the (j−1)th scan signal SCAN(j−1) is inverted to the low level, the second transistor T2 turns off, and the current path between the input terminal of the high-level driving voltage ELVDD and the node A may be blocked.

During the sampling period Ts, the fifth transistor T5 turns on in response to the jth scan signal SCAN(j), and the node A and the node C are connected. Accordingly, the node C has the high-level driving voltage ELVDD, which is the voltage at the node A, and as the voltage at the node C rises, the driving transistor DT turns on. With the driving transistor DT turning on, the voltage at the node B rises by a drain-source current Ids to a voltage for turning off the driving transistor DT. At the same time, the first transistor T1 turns on in response to the jth scan signal SCAN(j), and provides a data voltage Vdata to the node B. That is, the voltage at the node B increases until Vdata is reached. Also, as the fifth transistor T5 turns on during the sampling period Ts, the node A and the node C are connected. So, the driving transistor DT becomes a diode-connected transistor (that is, the gate electrode and drain electrode of the driving transistor are shorted so that the driving transistor acts as a diode). Thus, the node A having the same voltage as the gate of the driving transistor DT corresponds to a voltage of the sum of the voltage Vdata at the node B and the threshold voltage Vth.

Next, during the sampling period Ts, the sixth transistor T6 turns on in response to the jth scan signal SCAN(j), and provides the initial voltage Vini to the node D. The initial voltage Vini is set to a voltage at which the organic light emitting diode OLED does not operate. That is, a low voltage is applied to the anode of the organic light emitting diode OLED during the sampling period Ts, thereby preventing the organic light emitting diode OLED from emitting light at times other than the light emission period Te.

In FIG. 5C, the transistors that operate during the light emission period Te are indicated by the solid lines, and the transistors that do not operate during this period are indicated by the dotted lines. Referring to FIGS. 4 and 5C, the light emission period Te continues until the start of the initial period Tj of the next frame following the completion of the sampling period Ts.

During the light emission period Te, the (j−1)th scan signal SCAN(j−1) and jth scan signal SCAN(j) are input at the low-voltage level (turn-off voltage), and the emission signal EM(j) is inverted to the high-voltage level (turn-on voltage). The third transistor T3 turns on in response to the emission signal EM(j), and therefore, during the light emission period Te, provides a driving current Ioled to the organic light emitting diode OLED in phase with the data voltage at the node B.

In the light emission period Te, the node D, which is initialized to the initial voltage Vini during the sampling period Ts, is set to the same voltage Voled as the organic light emitting diode OLED. This creates a voltage difference of "Voled−Vini" at the node D, and this voltage difference is also applied to the node A. Accordingly, the node A, which is held at the voltage of "Vdata+Vth" during the sampling period Ts, corresponds to a voltage of "Vdata+Vth+(Voled−Vini)".

During the light emission period Te, the node B also corresponds to the voltage of "Voled". That is, during the light emission period Te, the gate voltage of the driving transistor DT becomes "Vdata+Vth+(Voled−Vini)" and its source voltage becomes "Voled". Therefore, "Vgs={Vdata+Vth+(Voled−Vini)}−Voled=Vdata+Vth−Vini".

Accordingly, the relationship for the driving current Ioled flowing through the OLED during the light emission period Te is expressed by the following Equation 1:

$$Ioled=(k/2)(Vgs-Vth)^2=(k/2)(Vdata-Vini)^2 \quad \text{[Equation 1]}$$

wherein k indicates a proportional constant determined by the electron mobility, parasitic capacitance, and channel capacity of the driving transistor DT.

The organic light emitting diode OLED emits light by this driving current relationship, which enables a desired gray-scale representation. In other words, the relationship for the driving current Ioled of the organic light emitting diode OLED is $k/2(Vgs-Vth)^2$, and the Vgs programmed in the sampling period Ts already includes the Vth component. Thus, the Vth component is ultimately eliminated from the relationship for the driving current Ioled. This minimizes the effect of a change in threshold voltage Vth on the driving current Ioled.

As can be seen from the value of a voltage that is input according to the operating sequence of the pixels, the organic light emitting display according to the first exemplary embodiment does not use a reference voltage during the sampling period Ts, and this reduces transitions of the voltage output from the data driver 12. Accordingly, the power consumption of the data driver 12 may be reduced.

Moreover, in the organic light emitting display according to the first exemplary embodiment, the sampling period (or initial period in the sampling period) for the pixel of the jth row overlaps the period in which the data voltage is provided to the pixel of (j−1)th row. Accordingly, the first exemplary embodiment ensures a sufficient sampling period for the driving transistor. This allows for efficient compensation of the threshold voltage of the driving transistor DT.

Figure 6:
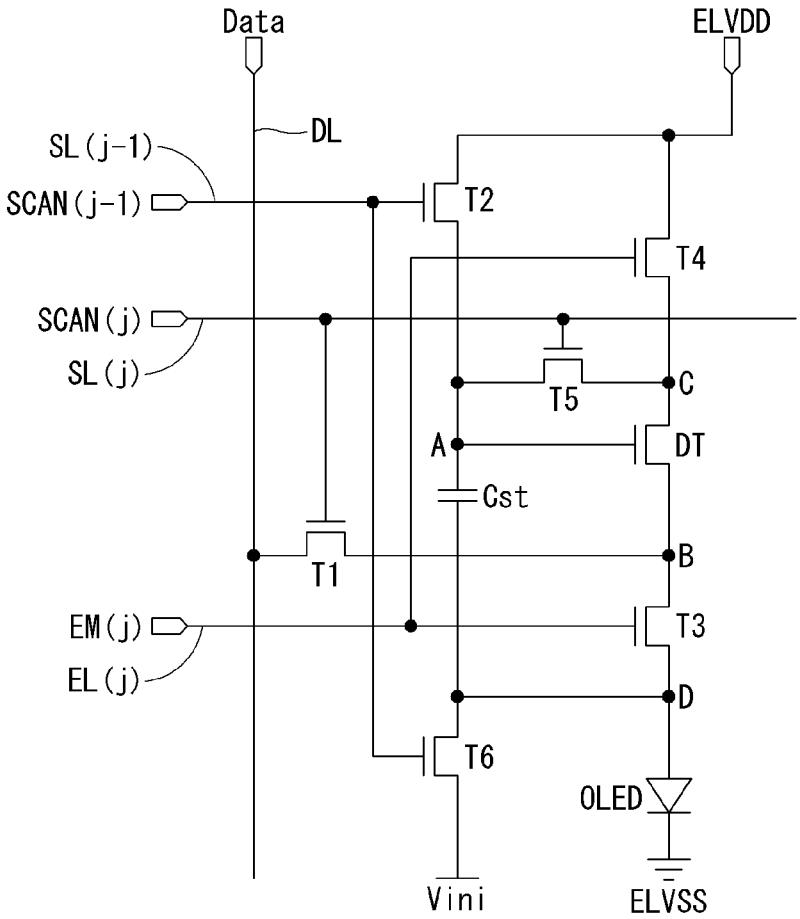
FIG. 6 is a view showing a pixel structure according to a second exemplary embodiment.

FIG. 6 is a view showing a pixel structure according to a second exemplary embodiment. Driving signals for the pixel structure according to the second exemplary embodiment are identical to those for the pixel structure of FIG. 4 according to the first exemplary embodiment. A detailed description of the components of the second exemplary embodiment substantially identical to those according to the foregoing exemplary embodiment will be omitted.

Referring to FIG. 6, the jth pixels PXL(j) arranged in the jth row will be described below.

Each of the jth pixels PXL(j) comprises an organic light emitting diode OLED, a driving transistor DT, first to sixth transistors T1 to T6, and a capacitor Cst. The exemplary embodiment discloses N-type transistors, the semiconductor type of the transistors is not limited thereto.

The organic light emitting diode OLED emits light by a current supplied from the driving transistor DT.

The driving transistor DT controls the driving current applied to the organic light emitting diode OLED based on its gate-source voltage Vgs. A gate electrode of the driving transistor DT is connected to a node A, its source electrode is connected to a node B, and its drain electrode is connected to a node C.

First and second electrodes of the first transistor T1 are connected to the node B and a data line DL, respectively, and its gate electrode is connected to the jth scan line SL(j). That is, the first transistor T1 is switched on in response to the jth scan signal SCAN(j) and transmits a data voltage from the data line DL to the node B.

First and second electrodes of the second transistor T2 are connected to the node A and an input terminal of the high-level driving voltage ELVDD, respectively, and its gate electrode is connected to the (j−1)th scan line SL(j−1). That is, the second transistor T2 transmits the high-level driving voltage ELVDD to the node A in response to the (j−1)th scan signal SCAN(j−1).

First and second electrodes of the third transistor T3 are connected to the node B and the anode of the organic light emitting diode OLED, respectively, and its gate electrode is connected to the jth emission line EL(j). That is, the third transistor T3 switches the current path between the driving transistor DT and the organic light emitting diode OLED, in response to the jth emission signal EM(j).

First and second electrodes of the fourth transistor T4 are connected to the node C and the input terminal of the high-level driving voltage ELVDD, respectively, and its gate electrode is connected to the jth emission line EL(j). That is, the fourth transistor T4 transmits the high-level driving voltage ELVDD to the node C in response to the jth emission signal EM(j).

First and second electrodes of the fifth transistor T5 are connected to the node A and the node C, respectively, and its gate electrode is connected to the jth scan line SL(j).

First and second electrodes of the sixth transistor T6 are connected to the node D and the initial voltage Vini, respectively, and its gate electrode is connected to the (j−1)th scan line SL(j−1).

The capacitor Cst is connected between the node A and the node D. The capacitor Cst is used to sample the threshold voltage of the driving transistor according to the source follower configuration.

Figure 7A:
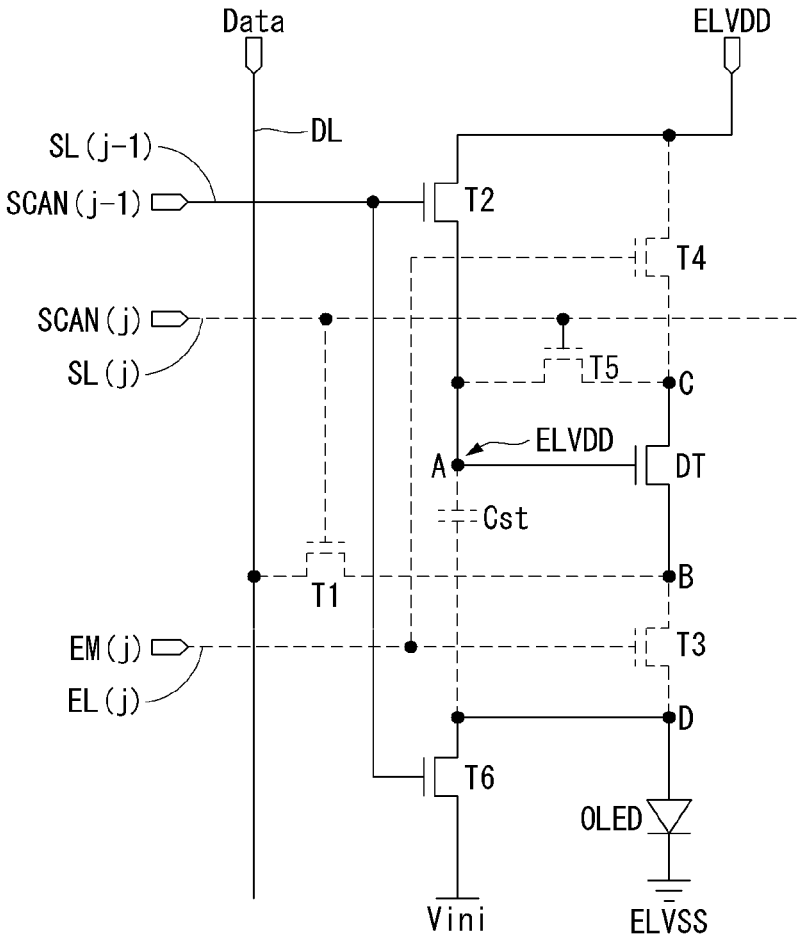
FIG. 7A is an equivalent circuit diagram for explaining operation of pixels during an initial period according to the second exemplary embodiment.
Figure 7B:
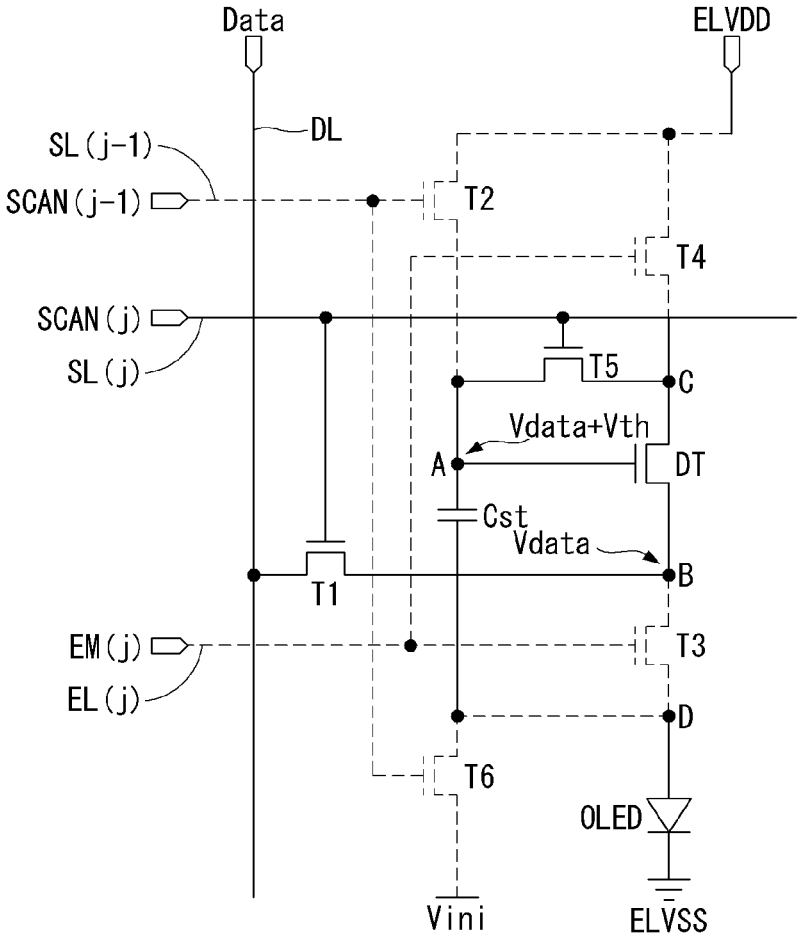
FIG. 7B is an equivalent circuit diagram for explaining operation of pixels during a sampling period according to the second exemplary embodiment.
Figure 7C:
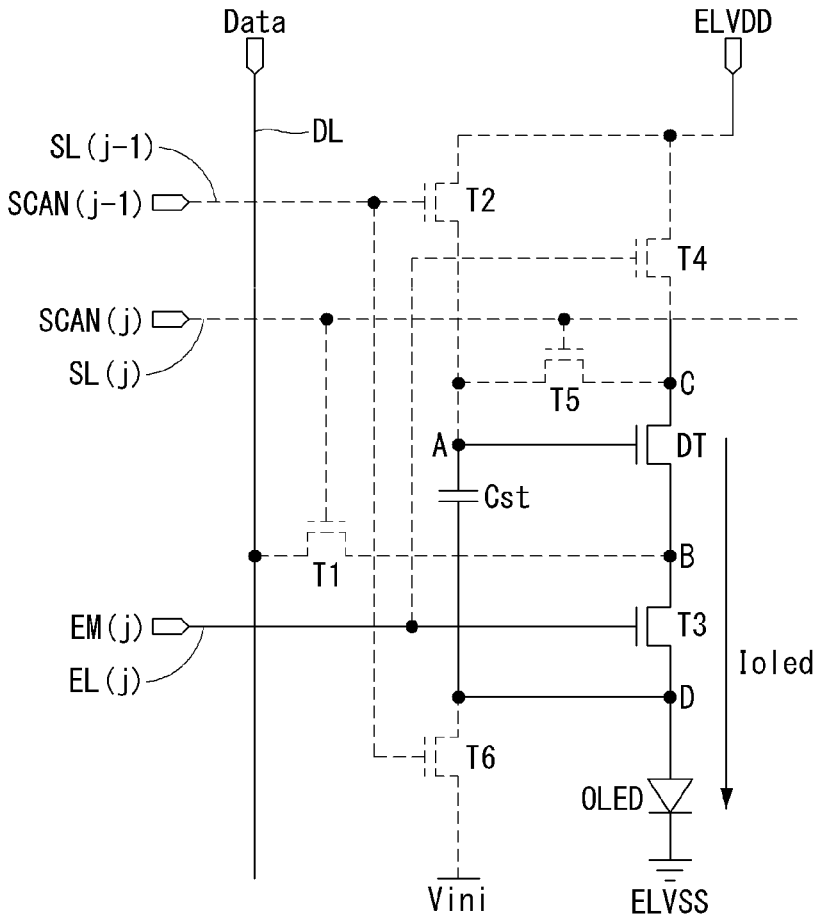
FIG. 7C is an equivalent circuit diagram for explaining operation of pixels during a light emission period according to the second exemplary embodiment.

In the second exemplary embodiment, the operation of the pixels arranged in the jth row R#j will be described below with reference to FIG. 4 and FIGS. 7A through 7C and [Table 2]. FIGS. 7A to 7C are equivalent circuit diagrams for explaining operation of the pixels in response to driving signals. [Table 2] is a table showing the voltages for each node corresponding to operation periods of the pixels. Detailed description of redundancies between the operations of the first and second exemplary embodiments will be omitted.

TABLE 2

| | Initial period | Sampling period | Light emission period |
|---|---|---|---|
| Node A | ELVDD | Vdata + Vth | Vdata + Vth + (Voled − Vini) |
| Node B | Voled | Vdata | Voled |
| Node D | Vini | Vini | Voled |

In the second exemplary embodiment, gate signals for driving the pixels are identical to those of the first exemplary embodiment. The operation of the pixels according to the second exemplary embodiment comprises an initial period Tj, a sampling period Ts, and a light emission period Te.

Referring to FIG. 7A, the transistors that operate during the initial period Tj are indicated by the solid lines, and the transistors that do not operate during this period are indicated by the dotted lines. During the initial period Tj, the (j−1)th scan signal SCAN(j−1) is input at the high-voltage level, and the jth scan signal SCAN(j) and the emission signal EM(j) are input at the low-voltage level. The second transistor T2 turns on in response to the (j−1)th scan signal SCAN(j−1), and provides the high-level driving voltage ELVDD to the node A. That is, the node A is initialized to the high-level driving voltage ELVDD during the initial period Tj.

The jth emission signal EM(j) is inverted to a turn-off voltage level, and the third transistor T3 turns off. As a result, the current path between the driving transistor DT and the organic light emitting diode OLED is blocked during the initial period Tj.

Next, during the initial period Tj, the sixth transistor T6 turns on in response to the (j−1)th scan signal SCAN(j−1), and provides an initial voltage Vini to the node D. That is, the initial voltage Vini, which is lower than the low-level driving voltage ELVSS, is applied, thereby preventing the organic light emitting diode OLED from emitting light at times other than the light emission period Te.

Referring to FIG. 7B, the transistors that operate during the sampling period Ts are indicated by the solid lines, and the transistors that do not operate during this period are indicated by the dotted lines. The sampling period Ts processes for the jth horizontal period jH in which a data voltage is applied to the jth pixels PXL(j).

During the sampling period Ts, the (j−1)th scan signal SCAN(j−1) is inverted to the low-voltage level, and the jth scan signal SCAN(j) is inverted to the high-voltage level. The emission signal EM(j) is held at the low-voltage level. As the (j−1)th scan signal SCAN(j−1) is inverted to the low-voltage level, the second transistor T2 turns off, and the current path between the input terminal of the high-level driving voltage ELVDD and the node A is blocked.

During the sampling period Ts, the fifth transistor T5 turns on in response to the jth scan signal SCAN(j), and the node A and the node C are connected. Accordingly, the node C has the high-level driving voltage ELVDD, which is the voltage at the node A, and as the voltage at the node C rises, the driving transistor DT turns on. With the driving transistor DT turning on, the voltage at the node B rises by a drain-source current Ids to a voltage for turning off the driving transistor DT. At the same time, the first transistor T1 turns on in response to the jth scan signal SCAN(j), and provides a data voltage Vdata to the node B. That is, the voltage at the node B increases until Vdata is reached. Also, as the driving transistor DT turns on during the sampling period Ts, the node A and the node C are connected. So, the fifth transistor T5 becomes a diode-connected transistor (that is, the gate electrode and drain electrode of the driving transistor are shorted so that the driving transistor acts as a diode). Thus, the node A having the same voltage as the gate of the driving transistor DT is set to a voltage equal to the sum of the voltage Vdata at the node B and the threshold voltage Vth.

Referring to FIG. 7C, the transistors that operate during the light emission period Te are indicated by the solid lines, and the transistors that do not operate during this period are indicated by the dotted lines. The light emission period Te continues until the start of the initial period Tj of the next frame following the completion of the sampling period Ts.

During the light emission period Te, the (j−1)th scan signal SCAN(j−1) and jth scan signal SCAN(j) are input at the low-voltage level (turn-off voltage), and the emission signal EM(j) is inverted to the high-voltage level (turn-on voltage). The third transistor T3 turns on in response to the emission signal EM(j), and therefore, during the light emission period Te, provides a driving current Ioled to the organic light emitting diode OLED in phase with the data voltage at the node B.

In the light emission period Te, the node D, which is initialized to the initial voltage Vini during the initial period Tj, is set to the same voltage Voled as the organic light emitting diode OLED. This creates a voltage difference of "Voled−Vini" across the node D, and this voltage difference is also applied to the node A. Accordingly, the node A, which is held at the voltage of "Vdata+Vth" during the sampling period Ts, corresponds to a voltage of "Vdata+Vth+(Voled−Vini)".

During the light emission period Te, the node B also corresponds to the voltage of "Voled". That is, during the light emission period Te, the gate voltage of the driving transistor DT becomes "Vdata+Vth+(Voled−Vini)" and its source voltage becomes "Voled". Therefore, "Vgs={Vdata+Vth+(Voled−Vini)}−Voled=Vdata+Vth−Vini".

Accordingly, the relationship for the driving current Ioled flowing through the OLED during the light emission period Te is expressed by the above Equation 1.

That is, in the second exemplary embodiment, the Vth component is ultimately eliminated from the relationship for the driving current Ioled. This minimizes the effect of a change in threshold voltage Vth on the driving current Ioled.

Figure 8:
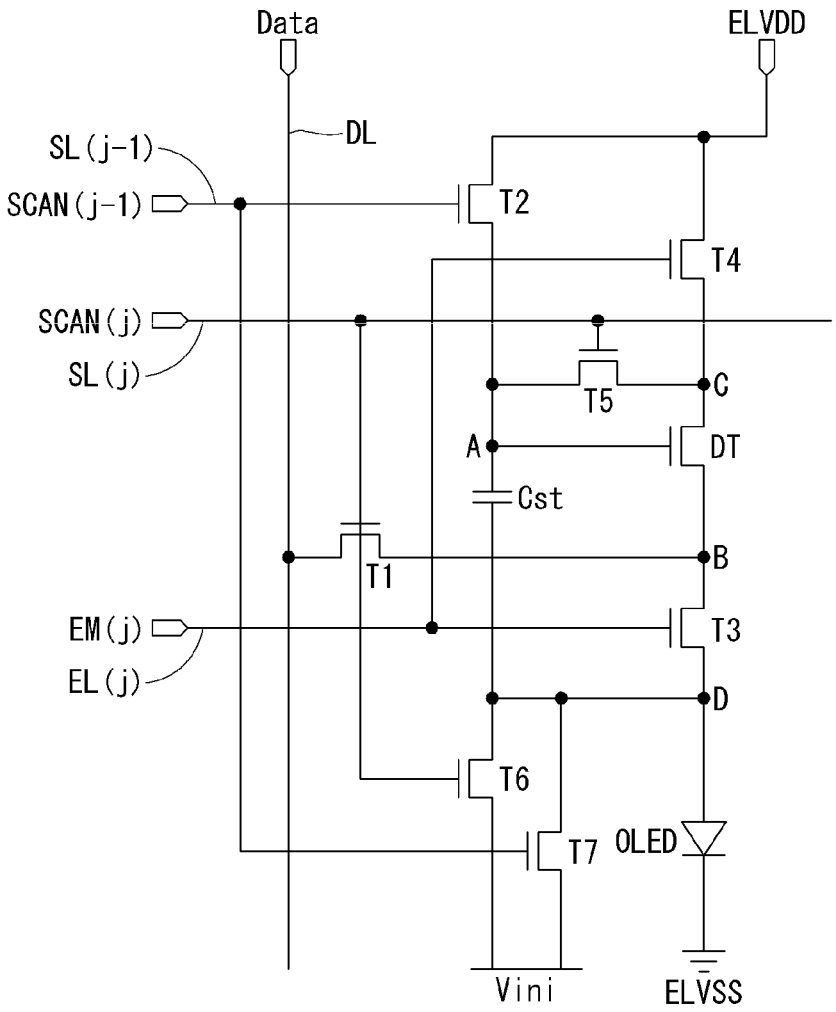
FIG. 8 is a view showing an organic light emitting display according to a third exemplary embodiment.

FIG. 8 is a view showing an organic light emitting display according to a third exemplary embodiment. FIG. 8 shows a modification embodiment of the first exemplary embodiment shown in FIG. 3. In FIG. 8, the same components as FIG. 3 are denoted by the same reference numerals, and a detailed description of them will be omitted. Also, the gate signals of FIG. 4 according to the first exemplary embodiment may be used as driving signals for driving the organic light emitting display according to the third exemplary embodiment.

The organic light emitting display according to the third exemplary embodiment further comprises a seventh transistor T7. A first electrode of the seventh transistor T7 is connected to the node D, its second electrode is connected to an input terminal of the initial voltage Vini, and its gate electrode is connected to the (j−1)th scan line SL[j−1] and receives the (j−1)th scan signal SCAN[j−1].

Figure 9A:
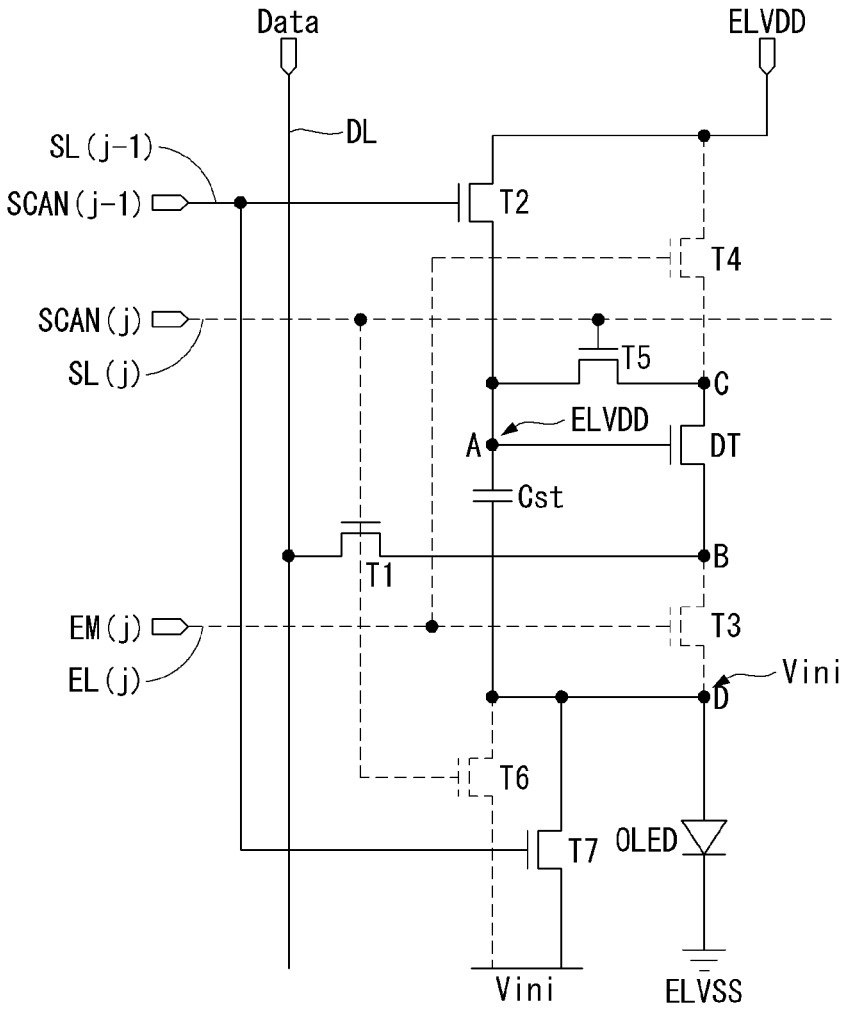
FIG. 9A is an equivalent circuit diagram for explaining operation pixels during an initial period according to the third exemplary embodiment.

In FIG. 9A, the transistors that operate during the initial period Tj are indicated by the solid lines, and the transistors that do not operate during this period are indicated by the dotted lines. FIG. 9A is an equivalent circuit diagram for explaining operation of the pixels during the initial period Tj according to the third exemplary embodiment. Referring to FIGS. 4, 8, and 9A to 9C, the seventh transistor T7 according to the third exemplary embodiment initializes the node D to the initial voltage Vini in response to the (j−1)th scan signal SCAN(j−1). That is, the initial voltage Vini, which is lower than the low level driving voltage ELVSS, is applied, thereby preventing the organic light emitting diode OLED from emitting light at times other than the light emission period Te.

Figure 9B:
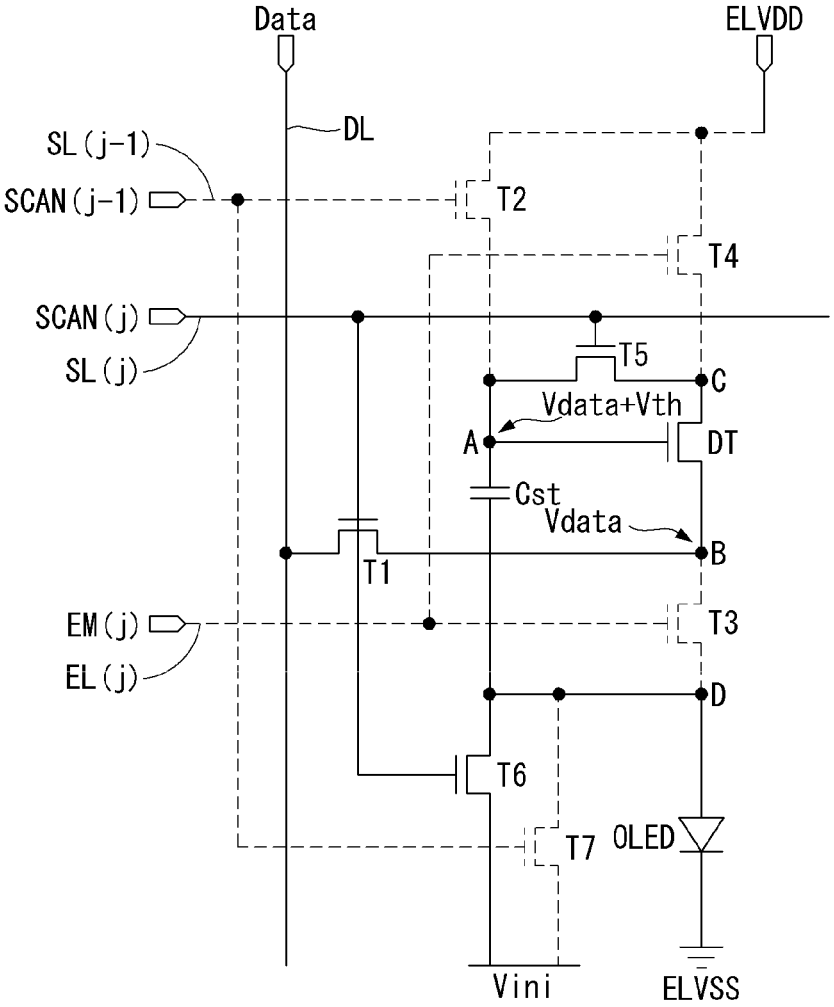
FIG. 9B is an equivalent circuit diagram for explaining operation pixels during a sampling period according to the third exemplary embodiment.
Figure 9C:
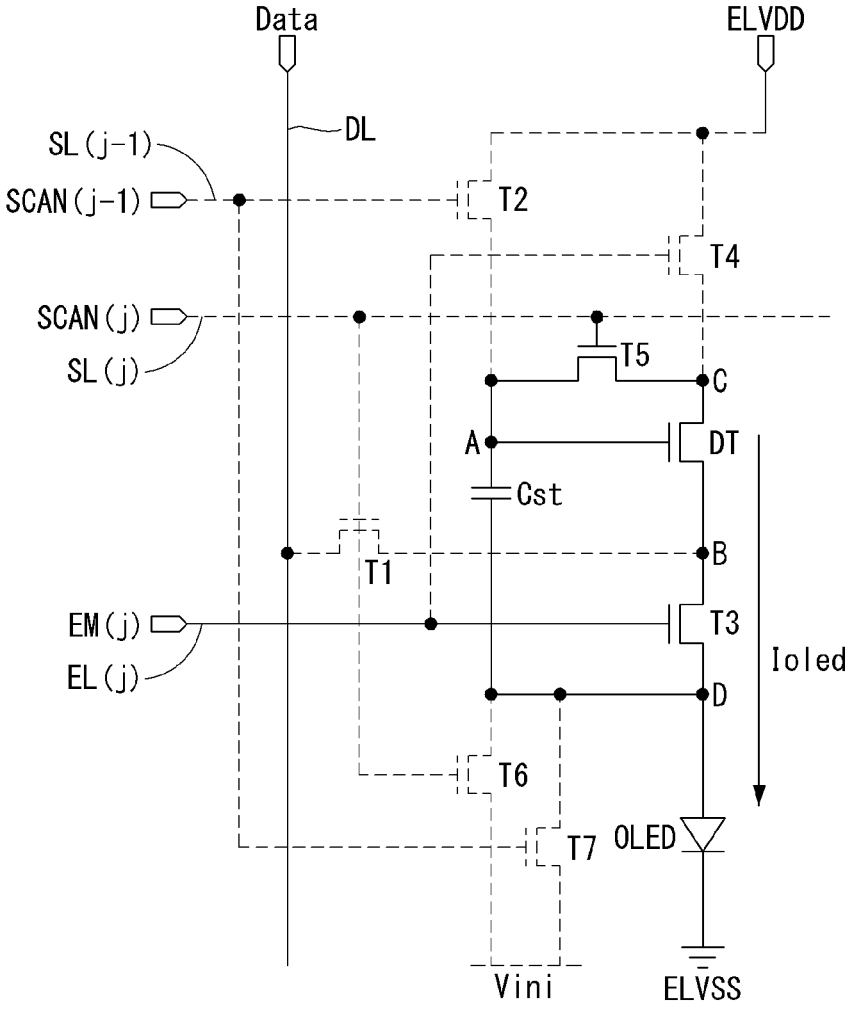
FIG. 9C is an equivalent circuit diagram for explaining operation pixels during a light emission period according to the third exemplary embodiment.

FIGS. 9B and 9C are views showing for explaining operation of the pixels during the sampling period Ts and the light emission period Te according to the third exemplary embodiment. The transistors that operate during the sampling period Ts and the light emission period Te are indicated by the solid lines, and the transistors that do not operate during these periods are indicated by the dotted lines. The transistors of the pixels operate the same as the above-described first exemplary embodiment during the sampling period Ts and the light emission period Te, so a detailed description thereof will be omitted.

In the organic light emitting display according to the third exemplary embodiment of the present disclosure, the node D is initialized during the (j−1)th horizontal period (j−1)H by using the seventh transistor T7, and the node D is initialized during the jth horizontal period jH by using the sixth transistor T6.

In the first exemplary embodiment of the present disclosure, the node D is initialized only during the jth horizontal period jH, which is the sampling period for the jth pixels P(j). In the first exemplary embodiment, the node D is in an electrically floating state during the (j−1)th horizontal period (j−1)H. Thus, the voltage at the node A rises instantly due to coupling of the capacitor Cst, in the initializing process of the node A to the high-level driving voltage ELVDD during the (j−1)th horizontal period (j−1)H. As a consequence, the organic light emitting diode OLED may emit light instantly. That is, in the first exemplary embodiment, pixels may emit light at an unwanted time during the initial period.

On the contrary, in the third exemplary embodiment shown in FIG. 8, the node D is initialized to the initial voltage Vini during the initial period Tj as well by using the seventh transistor T7. That is, the seventh transistor T7 holds the node D at the initial voltage Vini at which the organic light emitting diode OLED does not operate, thereby preventing a rise in the voltage at the node D. As a consequence, the third exemplary embodiment may prevent the organic light emitting diode OLED from emitting light at an unwanted time during the initial period Tj due to the rise in the voltage at the node D. Also, a low voltage may be applied to the anode of the organic light emitting diode OLED during the initial period Tj, thereby preventing the organic light emitting diode OLED from emitting light at times other than the light emission period Te due to coupling of the capacitor in the initializing process of the gate electrode of the driving transistor to the high-level driving voltage.

Figure 10:
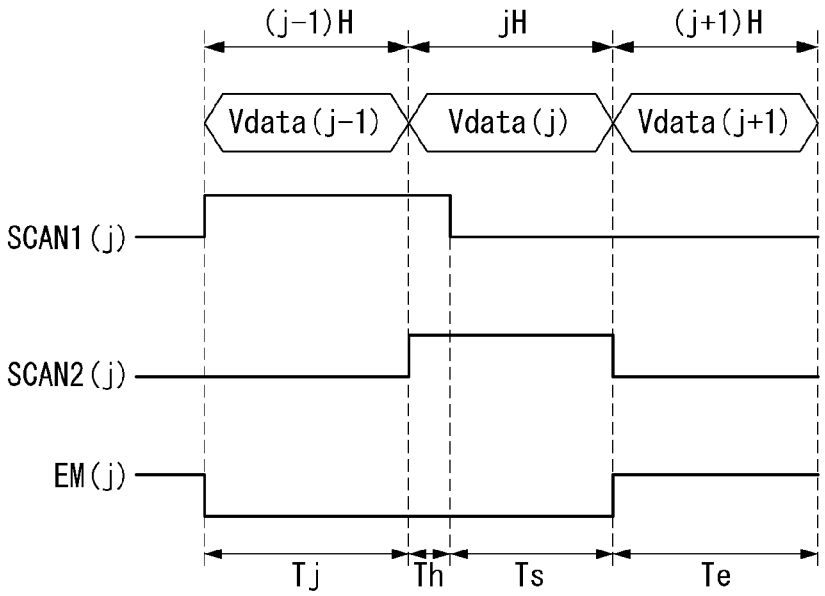
FIG. 10 is a timing diagram of gate signals according to the second exemplary embodiment.

FIG. 10 is a timing diagram of gate signals according to the second exemplary embodiment, which is a modification of FIG. 4. The timing diagram of the gate signals of FIG. 10 according to the second exemplary embodiment may apply to the pixels of FIGS. 3 and 8 according to the first and third exemplary embodiments of the present disclosure.

In the first and third exemplary embodiments, the sixth transistor T6 initializes the node D to the initial voltage Vini, in response to a 2jth scan signal SCAN2(*j*) applied at a turn-on voltage, during the sampling period Ts. That is, the voltage at the node D works as the operating voltage Voled of the organic light emitting diode OLED until the start of the sampling period Ts, and is initialized to the initial voltage Vini during the sampling period Ts. Since the initial voltage Vini is set to a voltage lower than the operating voltage Voled of the organic light emitting diode OLED, the voltage at the node D decreases during the initial period Tj. The operation of the pixels during the sampling period Ts according to the first exemplary embodiment is as shown in FIG. 5B, and the operation of the pixels during the sampling period Ts according to the third exemplary embodiment is as shown in FIG. 9B. As shown in FIGS. 5B and 9B, in the first and third exemplary embodiments, the node A floats during the sampling period Ts. When the voltage at the node A is initialized to the initial voltage Vini while the node A is floating state, the voltage at the node A decreases due to coupling of the capacitor Cst. As a consequence, the voltage at the node A, which normally has to be sampled as a voltage value of "Vdata+Vth", decreases, thus leading to the problem of not sensing the threshold voltage Vth.

In comparison, according to the timing diagram of the gate signals of FIG. 10 according to the second exemplary embodiment of the present disclosure, the operation of the pixels comprises a high-voltage holding period Th at the initial stage of the sampling period Ts. During the high-voltage holding period Th, the second transistor T2 supplies the high-level driving voltage ELVDD to the node A in response to the 1(j)th scan signal SCAN1(*j*). Accordingly, the organic light emitting display according to the first and third exemplary embodiments may prevent a voltage drop at the node A due to coupling effect of the capacitor Cst since the node D is initialized. Also, by supplying the high-level driving voltage to the gate electrode of the driving transistor at the initial stage of the sampling period, the present disclosure prevents a voltage drop at the gate electrode of the driving transistor due to coupling of the capacitor Cst in the initializing process of the organic light emitting diode. Moreover, the high-level driving voltage may be applied to other electrodes of the capacitor in response to the gate voltage of the driving transistor during the high-voltage holding period, thereby preventing a voltage drop at the gate electrode of the driving transistor.

As for the gate signals according to the second exemplary embodiment, a first scan signal SCAN1(*j*) and second scan signal SCAN2(*j*) provided in the pixel of jth row R#j have different pulses widths, as shown in FIG. 10. Accordingly, the gate signals of FIG. 10 according to the second exemplary embodiment may be individually output by using individual shift registers. In order to use the gate signals according to the second exemplary embodiment, a first scan line to which the first scan signal SCAN1(*j*) is applied and a second scan line to which the second scan signal SCAN2(*j*) is applied may be arranged in each pixel of R#1 to R#(n) row.

Figure 11:
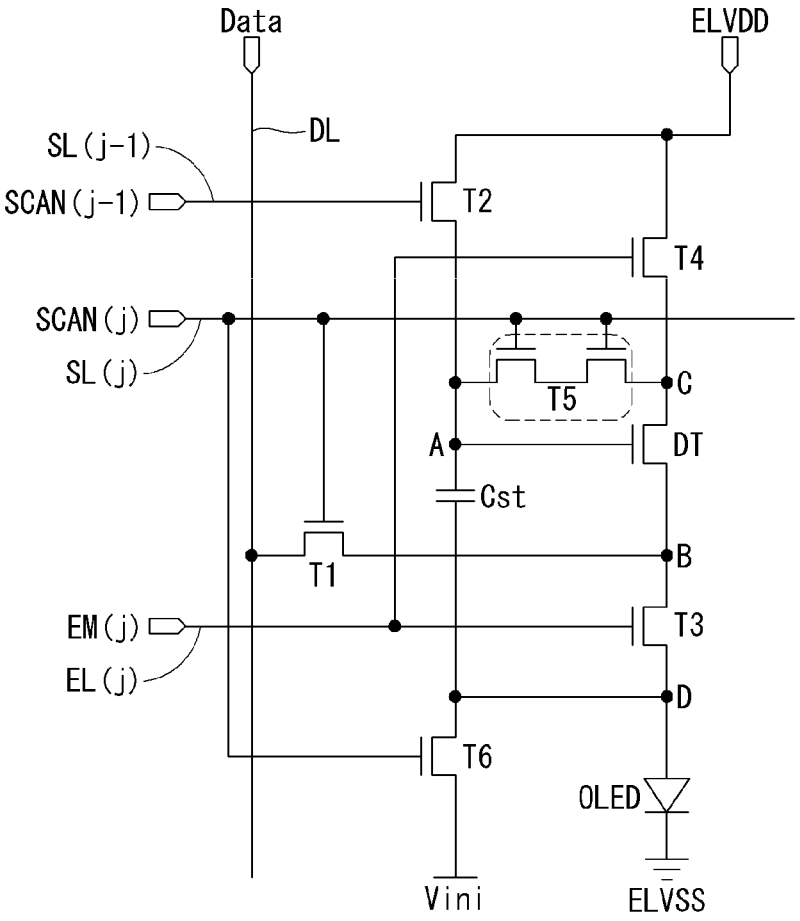
FIG. 11 is a view showing a modification embodiment of the first exemplary embodiment.

FIG. 11 is a view showing a modification embodiment of the first exemplary embodiment shown in FIG. 3. In FIG. 11, the same components as the first exemplary embodiment are denoted by the same reference numerals, and a detailed description of them will be omitted.

The first and second electrodes of the fifth transistor T5 are connected to the node A and node C, respectively, and its gate electrode is connected to the jth scan line SL(j). The fifth transistor T5 has a double-gate structure, which can reduce leakage current. If a leakage current occurs while the fifth transistor T5 is in the off state, the voltage across the capacitor Cst is lowered. Once the voltage across the capacitor Cst is lowered, the gate-source voltage of the driving transistor DT changes. The gate-source voltage of the driving transistor DT determines the luminance of the organic light emitting diode OLED, and as a result, the leakage current of the fifth transistor T5 causes a change in luminescence intensity. Accordingly, the double-gate structure of the fifth transistor T5 connected to the capacitor Cst may reduce the leakage current of the fifth transistor T5 and prevent an unwanted change in luminescence intensity.

That is, if a leakage current occurs to a transistor connected to the capacitor Cst, this may cause distortion in luminescence intensity. This can be solved by applying a double-gate structure to the transistor connected to the capacitor Cst.

For instance, the second transistor T2 also may have a double-gate structure. Alternatively, at least one of the second and fifth transistors T2 and T5 may have a double-gate structure.

Accordingly, the gate structure of the second and fifth transistors T2 and T5 may be any one selected from among those illustrated in the following [Table 3].

TABLE 3

| Second transistor | Fifth transistor |
|---|---|
| Single gate | Single gate |
| Single gate | Double gate |
| Double gate | Single gate |
| Double gate | Double gate |

Also, the second and fifth transistors T2 and T5 with the double-gate structure may be equally used in the pixel structure of FIG. 6 according to the second exemplary embodiment and the pixel structure of FIG. 8 according to the third exemplary embodiment.

The pixel structures of FIGS. 3, 6, and 8 according to the above-described exemplary embodiments comprise transistors and a capacitor which have their distinctive technical characteristics. These pixel structures may be seen in a pixel array for a display panel.

Figure 12:
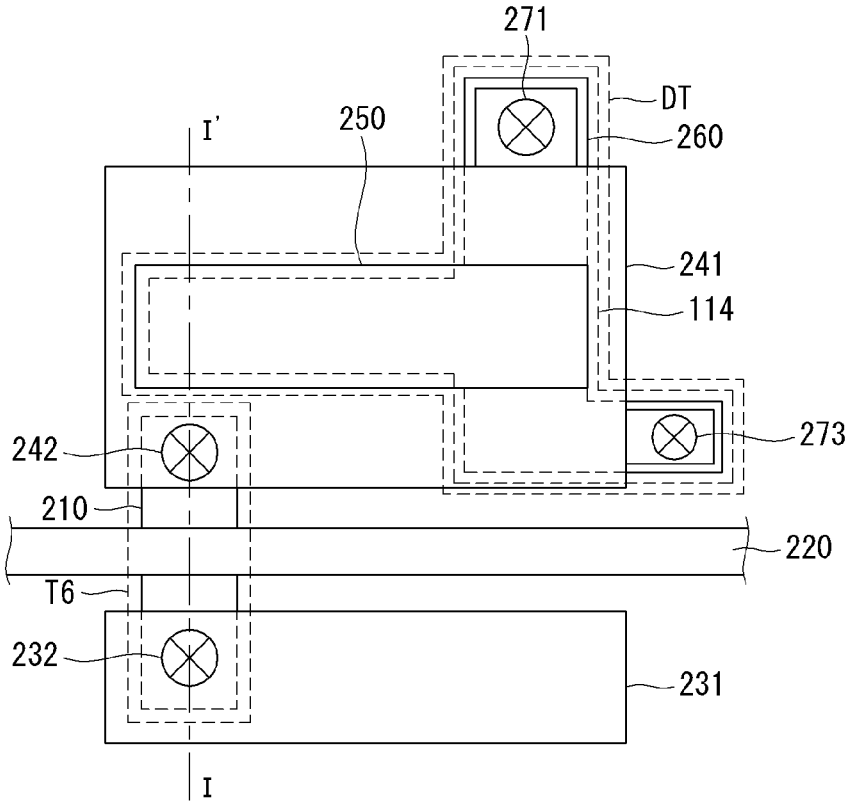
FIG. 12 is a view showing an array of a region for forming a capacitor in a pixel according to an exemplary embodiment of the present disclosure.

FIG. 12 is a view showing a planar array in a capacitor forming region in FIGS. 3, 6, and 8. In the description of FIG. 8, the seventh transistor T7 may be substituted for the sixth transistor T6.

Figure 13:
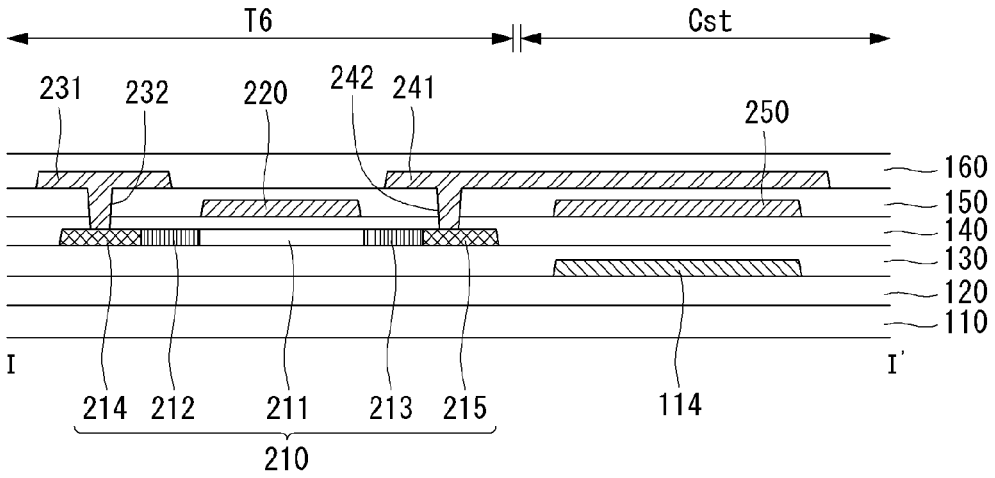
FIG. 13 is a cross-sectional view taken along line I-I' of FIG. 12 according to an exemplary embodiment of the present disclosure.

Referring to FIG. 12 and FIG. 13, a cross-sectional view of the sixth transistor T6 and capacitor Cst of FIG. 12 taken along line I-I', the sixth transistor T6 comprises a semiconductor layer 210, a drain electrode connected to the semiconductor layer 210 through a contact hole 242, and a source electrode 231 connected to the semiconductor layer 210 through a contact hole 232, and the capacitor Cst comprises a first electrode 241 and a second electrode. The first electrode 241 of the capacitor Cst is connected to the drain electrode of the sixth transistor T6, and the second electrode is a gate electrode 250 of the driving transistor DT. The source electrode 231 of the sixth transistor T6 may be connected to an initial voltage input terminal. Also, a semiconductor layer 260 of the driving transistor DT is formed below the gate electrode 250, and a source contact hole 271 and a drain contact hole 273 may be connected to a source electrode and a drain electrode, each of a respective transistor.

The first electrode 241 of the capacitor Cst is not connected to a high-level driving voltage input terminal, but is connected to the initial voltage input terminal. Thus, the first electrode 241 of the capacitor can be designed with ease to share a single contact hole. For example, the first electrode of the capacitor of FIG. 8 shares a single contact hole with the sixth and seventh transistors, resulting in a reduction in the number of contact holes and ensuring sufficient design margin.

The transistors may be formed on a substrate 110, and the substrate 110 may be made of a polyimide insulating layer. In this case, a mobile charge is generated in the polyimide insulating layer. This may affect the semiconductor layers of the transistors and reduce the driving current. The transistors discussed herein may be a transistor array comprising at least one transistor. Accordingly, the first electrode 241 may be larger than the gate electrode 250 of the driving transistor DT. In this way, the initial voltage Vini is applied to the first electrode 241, thus suppressing the effect of a mobile charge in the substrate 110. This can improve the reduction in the driving current of the driving transistor DT caused by the mobile charge. The initial voltage Vini may be a negative voltage.

Alternatively, a metal layer 114 may be positioned under the semiconductor layer 260 of the driving transistor DT to decrease the effect of the mobile charge on the semiconductor layer 260 of the driving transistor DT. The metal layer 114 may be the same size as or larger than the semiconductor layer 260 of the driving transistor DT.

The first electrode 241 of the capacitor Cst may be extended to become a transistor that samples the threshold voltage of the driving transistor DT or a transistor that operates during the sampling period. Also, the first electrode 241 of the capacitor Cst may be disposed in an area corresponding to a semiconductor layer of the fifth transistor to decrease the effect of the mobile charge on the semiconductor layer of the fifth transistor. Referring to FIG. 13, a first buffer layer 120 is positioned on the substrate 110. The first buffer layer 120 may be formed of any one among silicon oxide (SiOx), silicon nitride (SiNx), and a multi-layer thereof.

The metal layer 114 is positioned on the first buffer layer 120, and the metal layer 114 may be made of a semiconductor, such as silicon (Si), or a conductive metal; for example, any one among molybdenum (Mo), aluminum (Al), chrome (Cr), gold (Au), titanium (Ti), nickel (Ni), neodymium (Nd), copper (Cu), and an alloy of two or more thereof.

The substrate 110 may be a glass, plastic, or polyimide insulating layer, and may be composed of two or more layers. The substrate 110 may be a substrate with flexibility. Accordingly, a flexible organic light emitting display may be formed of a flexible material such as plastic. Also, when organic light emitting diodes that allow for easy fabrication of flexible displays are used in vehicle lighting or vehicle displays, the vehicle lighting or vehicle displays may have various designs and offer design freedom depending on their structure or appearance.

A second buffer layer 130 is positioned on the metal layer 114. The second buffer layer 130 may be formed of any one among silicon oxide (SiOx), silicon nitride (SiNx), and a multi-layer thereof.

The semiconductor layer 210 is positioned on the second buffer layer 130. The semiconductor layer 210 may comprise silicon semiconductor or oxide semiconductor. The semiconductor layer 210 of the sixth transistor T6 comprises a drain region 214, a source region 215, lightly-doped regions 212 and 213, and a channel region 211 positioned between the lightly-doped regions 212 and 213. The semiconductor layer 210 may be doped with an n-type impurity such as phosphorous (P), arsenic (As), or antimony (Sb). The semiconductor layer 260 of the driving transistor DT may be formed by the same process as the semiconductor layer 210 of the sixth transistor T6.

A first insulating layer 140 is positioned on the semiconductor layer 210. The first insulating layer 140 may be formed of any one among silicon oxide (SiOx), silicon nitride (SiNx), and a multi-layer thereof.

A gate electrode 220 of the sixth transistor T6 is positioned above the channel region 211 of the semiconductor layer 210. The gate electrode 220 may be formed of any one among molybdenum (Mo), aluminum (Al), chrome (Cr), gold (Au), titanium (Ti), nickel (Ni), neodymium (Nd), copper (Cu), and an alloy of two or more thereof. The gate electrode 250 of the driving transistor DT may be formed by the same process as the gate electrode 220 of the sixth transistor T6.

A second insulating layer 150 is positioned on the gate electrodes 220 and 250. The second insulating layer 150 may be formed of any one among silicon oxide (SiOx), silicon nitride (SiNx), and a multi-layer thereof.

The first electrode 241 of the capacitor Cst and the drain electrode and source electrode of the sixth transistor T6, all of which are electrically connected to an initial voltage (Vini) supply line, are positioned on the second insulating layer 150. Although FIGS. 12 and 13 illustrate that part of the first electrode 241 of the capacitor Cst corresponds to the drain electrode of the sixth transistor T6, the first electrode 241 of the capacitor Cst may be used as a second gate electrode, as well as a drain electrode or a gate electrode. Like the gate electrode 220, the second gate electrode may be formed of any one among molybdenum (Mo), aluminum (Al), chrome (Cr), gold (Au), titanium (Ti), nickel (Ni), neodymium (Nd), copper (Cu), and an alloy of two or more thereof. The area of the first electrode 241 that receives the initial voltage may be larger than the area of the second electrode of the capacitor Cst.

A third insulating layer 160 is positioned on the first electrode 241 of the capacitor Cst and the drain electrode of the sixth transistor T6. The third insulating layer 160 may be formed of any one among silicon oxide (SiOx), silicon nitride (SiNx), and a multi-layer thereof.

An organic light emitting diode comprises an anode connected to the first electrode 241 of the capacitor Cst and a cathode opposite to the anode. An organic light emitting display of this specification may be used in applications such as TV, mobile, tablet PCs, monitors, smartwatches, laptop computers, vehicle displays, etc. An organic light emitting display of this specification also may be used in displays of various shapes such as flat displays, bendable displays, foldable displays, and rollable displays.

The exemplary embodiments of this disclosure ensure a sufficiently long threshold voltage sampling period because the gate electrode of the driving transistor is initialized during the previous horizontal period. Accordingly, the threshold voltage of the driving transistor can be efficiently compensated.

Moreover, the exemplary embodiments of this disclosure can reduce transitions of the data voltage output from the data driver since they does not use a reference voltage. Accordingly, the power consumption of the data driver can be reduced.

In addition, by applying a low voltage to the anode of an organic light emitting diode connected to one electrode of the capacitor, the exemplary embodiments of this disclosure can prevent the organic light emitting diode from emitting light at other times than the light emission period due to coupling of the capacitor in the initializing process of the gate electrode of the driving transistor, connected to another electrode of the capacitor, to the high-level driving voltage.

Furthermore, the exemplary embodiments of this disclosure can prevent a voltage drop at the gate electrode of the driving transistor due to coupling of the storage capacitor in the initializing process of the organic light emitting diode, by initializing the organic light emitting diode during the sampling period and, if one electrode of the capacitor is connected to the anode of the organic light emitting diode and another electrode of the capacitor is connected to the gate electrode of the driving transistor, supplying the high-level driving voltage to the gate electrode of the driving transistor at the initial stage of the sampling period.

Furthermore, the exemplary embodiments of this disclosure can prevent distortion in luminescence caused by leakage current by having double-gate transistors connected to the capacitor.

Furthermore, the exemplary embodiments of this disclosure can reduce the effect of a mobile charge on the semiconductor layer of the driving transistor by placing a metal layer under the semiconductor layer of the driving transistor.

Furthermore, the exemplary embodiments of this disclosure can reduce the effect of a mobile charge on the semiconductor layer of the driving transistor because one electrode of the capacitor has a larger area than the gate electrode of the driving transistor.

Furthermore, the exemplary embodiments of this disclosure can reduce the effect of a mobile charge on the semiconductor layer of transistors by placing one electrode of the capacitor in an area corresponding to the semiconductor layer of the transistors that operate during the sampling period.

Furthermore, the exemplary embodiments of this disclosure can ensure design margin by reducing the number of contact holes within a pixel because one electrode of the capacitor is connected to the initial voltage input terminal, rather than the high-level driving voltage input terminal, thus allowing the one electrode of the capacitor to be connected to the initial voltage input terminal and the transistors via a single contact hole.

Exemplary embodiments of this disclosure may be explained as follows.

In an exemplary embodiment of this disclosure, an organic light emitting display comprises a display panel having a plurality of pixels, a gate drive circuit that drives scan lines and emission lines on the display panel, and a data drive circuit that drives data lines on the display panel. Each of the pixels is arranged in an nth row (n is a natural number) comprising a driving transistor that comprises a gate electrode connected to a node A, a source electrode connected to a node B, and a drain electrode connected to a node C, and the driving transistor controlling a driving current applied to an organic light emitting diode, a first transistor that is connected between the data lines and the node B, a second transistor that is connected between the node A and a high-level driving voltage input terminal, a third transistor that is connected to the node B and the organic light emitting diode, a fourth transistor that is connected to the node C and the high-level driving voltage input terminal, a fifth transistor that is connected to the node A and the node C; a sixth transistor that is connected between a node D and an initial voltage input terminal, the node D located between the third transistor and the organic light emitting diode, and a capacitor that is connected to the node A and the node D. This ensures a sufficient sampling period for the driving transistor and allows for efficient compensation of the threshold voltage of the driving transistor.

A (j−1)th scan signal in which a data voltage is provided to the pixels arranged in a (j−1)th row has a turn-on voltage during a (j−1)th horizontal period, a jth scan signal has the turn-on voltage in which the data voltage is provided to the pixels arranged in a jth row during a jth horizontal period, and an emission signal provided to the jth row has the turn-on voltage after the jth scan signal is inverted to a turn-off voltage.

During the (j−1)th horizontal period, the second transistor applies the high-level driving voltage received from the high-level driving voltage input terminal to the node A, in response to the (j−1)th scan signal.

During the jth horizontal period, the first transistor applies the data voltage received from the data line to the node B, in response to the jth scan signal, and the fifth transistor connects the node A and the node C to operate the driving transistor, in response to the jth scan signal.

During a (j+1)th horizontal period, the fourth transistor connects the high-level driving voltage input terminal and the node C, in response to the emission signal, and the third transistor connects the node B and the node D, in response to the emission signal, and the node D corresponds to an operating voltage of the organic light emitting diode from the initial voltage level by the driving current, and a difference between the initial voltage level and the operating voltage of the organic light emitting diode is applied to the node A so as to emit light of the organic light emitting diode while compensating the threshold voltage of the driving transistor.

A gate electrode of the sixth transistor is connected to a (j−1)th scan line, and during a (j−1)th horizontal period, the sixth transistor applies the initial voltage received from the initial voltage input terminal to the node D, in response to a (j−1)th scan signal.

A gate electrode of the sixth transistor is connected to a jth scan line, and during a jth horizontal period, the sixth transistor applies the initial voltage received from the initial voltage input terminal to the node D, in response to a jth scan signal.

Each of the pixels arranged in the jth row further comprises a seventh transistor that is connected between the node D and the initial voltage input terminal and that is switched on in response to a (j−1)th scan signal.

During a (j−1)th horizontal period, the seventh transistor provides the initial voltage to the node D, in response to the (j−1)th scan signal.

The initial voltage is lower than the driving voltage of the organic light emitting diode.

The jth horizontal period further includes a high-voltage holding period, and a high-level driving voltage is applied to the node A in response to the (j−1)th scan signal during the high-voltage holding period.

At least one among the second transistor and the fifth transistor has a double-gate structure.

The organic light emitting display further comprises a metal layer under a semiconductor layer of the driving transistor.

A first electrode of the capacitor that receives an initial voltage from the initial voltage input terminal corresponds to the gate electrode of the driving transistor.

A first electrode of the capacitor that receives an initial voltage from the initial voltage input terminal is disposed in an area corresponding to a semiconductor layer of the fifth transistor that operates during a sampling period.

Another exemplary embodiment of this specification provides a circuit of an organic light emitting display, the circuit comprising a transistor array having at least one transistor, and a capacitor that is connected between an initial voltage input terminal and the at least one transistor, the capacitor having a first electrode and a second electrode. The area of the first electrode that receives an initial voltage is larger than the area of the second electrode. This can decrease the effect of a mobile charge on the semiconductor layer of the driving transistor.

The first electrode is disposed in an area corresponding to a semiconductor layer of a transistor that operates during a sampling period.

The transistor array is on a flexible substrate, and comprising a driving transistor, and a metal layer under a semiconductor layer of the driving transistor.

The first electrode of the capacitor is not connected to a high-level driving voltage input terminal, and is connected to the initial voltage input terminal, thereby reducing the number of contact holes.

The circuit further comprises an organic light emitting diode having an anode connected to the first electrode of the capacitor and a cathode opposite to the anode. A driving transistor in the transistor array is compensated by the capacitor that receives the initial voltage.

At least one of the transistors connected to the capacitor has a double-gate structure.

In an another exemplary embodiment of this disclosure, an organic light emitting display comprises a display panel having a plurality of pixels, each of the pixels including a driving transistor, an organic light emitting diode, and a capacitor electrically connected to each other. A single frame includes an initial period in which a gate voltage of the driving transistor is initialized, a sampling period for compensating a threshold voltage of the driving transistor, and a light emission period in which the organic light emitting diode emits light. A value corresponding to an image signal to be displayed by the organic light emitting diode is applied to the data line during the sampling period, and an initial voltage is applied to at least one electrode of the capacitor during the initial period. This can prevent a voltage drop at the gate electrode of the driving transistor due to coupling of the capacitor in the initializing process of the organic light emitting diode.

The sampling period comprises a period in which the initial period is held.

A high-voltage holding period exists at an initial stage of the sampling period, and a high-level driving voltage is applied to other electrode of the capacitor in response to a gate voltage during the high-voltage holding period.

The initial period for a pixel of jth row overlaps the period in which a data voltage is provided to a pixel o (j−1)th row.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel having a plurality of pixels;

a gate drive circuit that drives scan lines and emission lines on the display panel; and a data drive circuit that drives data lines on the display panel, each of the pixels arranged in an nth row (n is a natural number) comprising:

a driving transistor having a gate electrode connected to a node A, a source electrode connected to a node B, and a drain electrode connected to a node C, and the driving transistor controlling a driving current applied to an organic light emitting diode;

a first transistor that is connected between the data lines and the node B, the first transistor including a gate electrode that is connected to a jth scan line (j is a natural number less than n);

a second transistor that is connected between the node A and a high-level driving voltage input terminal, the second transistor including a gate electrode that is connected to a (j−1)th scan line;

a third transistor that is connected to the node B and the organic light emitting diode;

a fourth transistor that is connected to the node C and the high-level driving voltage input terminal;

a fifth transistor that is connected to the node A and the node C, the fifth transistor including a gate electrode that is connected to the jth scan line;

a sixth transistor that is connected between a node D and an initial voltage input terminal, the node D located between the third transistor and the organic light emitting diode, the sixth transistor including a gate electrode that is connected to the jth scan line; and a capacitor that is connected to the node A and the node D, wherein the second transistor is turned on responsive to the gate electrode of the second transistor receiving a (j−1)th scan signal from the (j−1)th scan line, and the first transistor, the fifth transistor, and the sixth transistor are turned on responsive to the gate electrodes of the first transistor, the fifth transistor, and the sixth transistor receiving a jth scan signal from the jth scan line, and wherein the (j−1)th scan signal in which a data voltage is provided to the pixels arranged in a (j−1)th row has a turn-on voltage during a (j−1)th horizontal period, and the jth scan signal has the turn-on voltage in which the data voltage is provided to the pixels arranged in a jth row during a jth horizontal period.

2. The organic light emitting display of claim 1, wherein an emission signal provided to the jth row has the turn-on voltage after the jth scan signal is inverted to a turn-off voltage.

3. The organic light emitting display of claim 2, wherein, during the (j−1)th horizontal period, the second transistor applies the high-level driving voltage received from the high-level driving voltage input terminal to the node A, in response to the (j−1)th scan signal.

4. The organic light emitting display of claim 3, wherein, during the jth horizontal period, the first transistor applies the data voltage received from the data line to the node B, in response to the jth scan signal, and the fifth transistor connects the node A and the node C to operate the driving transistor, in response to the jth scan signal.

5. The organic light emitting display of claim 4, wherein, during a (j+1)th horizontal period, the fourth transistor connects the high-level driving voltage input terminal and the node C, in response to the emission signal, and the third transistor connects the node B and the node D, in response to the emission signal, and the node D corresponds to an operating voltage of the organic light emitting diode from the initial voltage level by the driving current, and a difference between the initial voltage level and the operating voltage of the organic light emitting diode is applied to the node A so as to emit light of the organic light emitting diode while compensating the threshold voltage of the driving transistor.

6. The organic light emitting display of claim 5, wherein the initial voltage level is lower than the operating voltage of the organic light emitting diode.

7. The organic light emitting display of claim 2, wherein the jth horizontal period further includes a high-voltage holding period, and a high-level driving voltage is applied to the node A in response to the (j−1)th scan signal during the high-voltage holding period.

8. The organic light emitting display of claim 1, wherein a gate electrode of the sixth transistor is connected to a (j−1)th scan line, and during a (j−1)th horizontal period, the sixth transistor applies the initial voltage received from the initial voltage input terminal to the node D, in response to a (j−1)th scan signal.

9. The organic light emitting display of claim 8, wherein the jth horizontal period further includes a high-voltage holding period, and a high-level driving voltage is applied to the node A in response to the (j−1)th scan signal during the high-voltage holding period.

10. The organic light emitting display of claim 1, wherein during a jth horizontal period, the sixth transistor applies the initial voltage received from the initial voltage input terminal to the node D, in response to the jth scan signal.

11. The organic light emitting display of claim 10, wherein each of the pixels arranged in the jth row further comprises a seventh transistor that is connected between the node D and the initial voltage input terminal and that is switched on in response to a (j−1)th scan signal.

12. The organic light emitting display of claim 11, wherein, during a (j−1)th horizontal period, the seventh transistor provides the initial voltage to the node D, in response to the (j−1)th scan signal.

13. The organic light emitting display of claim 12, wherein the initial voltage is lower than the driving voltage of the organic light emitting diode.

14. The organic light emitting display of claim 10, wherein the jth horizontal period further includes a high-voltage holding period, and a high-level driving voltage is applied to the node A in response to the (j−1)th scan signal during the high-voltage holding period.

15. The organic light emitting display of claim 1, wherein at least one among the second transistor and the fifth transistor has a double-gate structure.

16. The organic light emitting display of claim 1, further comprising a metal layer under a semiconductor layer of the driving transistor.

17. The organic light emitting display of claim 1, wherein a first electrode of the capacitor that receives an initial voltage from the initial voltage input terminal is disposed in an area corresponding to an semiconductor layer of the driving transistor.

18. The organic light emitting display of claim 17, wherein the capacitor further includes a second electrode, wherein an area of the first electrode is larger than an area of the second electrode.

19. The organic light emitting display of claim 18, wherein the first electrode of the capacitor is not connected to the high-level driving voltage input terminal, and is connected to the initial voltage input terminal.

20. The organic light emitting display of claim 1, wherein a first electrode of the capacitor that receives an initial voltage from the initial voltage input terminal is disposed in an area corresponding to a semiconductor layer of the fifth transistor that operates during a sampling period.

* * * * *